United States Patent [19]

Hellwig

[11] 4,085,602

[45] Apr. 25, 1978

[54] KEY CASE HEAD

[75] Inventor: Oskar Alexander Hellwig, Springfield, Mass.

[73] Assignee: Beatrice Foods Co., Chicago, Ill.

[21] Appl. No.: 803,301

[22] Filed: Jun. 3, 1977

[51] Int. Cl.[2] ..... A47G 29/10

[52] U.S. Cl. ..... 70/456 B

[58] Field of Search ..... 70/456–459; 24/31 C; 150/40

[56] References Cited

U.S. PATENT DOCUMENTS

| | | | |
|---|---|---|---|
| 2,197,217 | 4/1940 | Geller | 70/456 B |
| 2,628,492 | 2/1953 | Sonntag | 70/456 B |
| 3,176,490 | 4/1965 | Rinaldi | 70/456 B |

*Primary Examiner*—Robert L. Wolfe

*Attorney, Agent, or Firm*—Chapin, Neal and Dempsey

[57] ABSTRACT

A key case head including an inner member and an outer member, the inner and outer members being adapted to cooperate to selectively retain and release key hooks, the inner member having attached thereto an actuator for moving the inner member relative to the outer member, the actuator and the outer member having complemental projections and recesses thereon for locking the inner member within the outer member.

2 Claims, 6 Drawing Figures

KEY CASE HEAD

BACKGROUND OF THE INVENTION

1. Field of the Invention

This invention relates to key case heads and is directed more particularly to means for permanently retaining an inner member within an outer member.

2. Description of the Prior Art

It is commonplace in the fabrication of key case heads to include as a step in the fabrication process the provision of a facility for retaining an inner member within an outer member. In some instances, after insertion of the inner member a crimping operation is performed in which portions of the inner or outer member are deformed in such a manner as to retain the members in their respective desired positions. In other instances, enlarged end pieces are added to either end to prevent escape of the inner member. In still other instances, the key hooks are relied upon to prevent separation of the inner and outer members. The latter retention means of course fails when all of the key hooks are removed.

SUMMARY OF THE INVENTION

It is, therefore, an object of the invention to provide means by which the inner member of a key case head is permanently retained in the outer member, but without the need of a specific fabrication step directed to that end, i.e., without crimping or adding parts.

With the above and other objects in view, as will hereinafter appear, a feature of the present invention is the provision of a key case head including an inner member and an outer member, the inner and outer members being adapted to cooperate to selectively retain and release key hooks, the inner member having attached thereto an actuator for moving the inner member relative to the outer member, the actuator and the outer member having complemental projections and recesses thereon for locking the inner member within the outer member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and featues of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
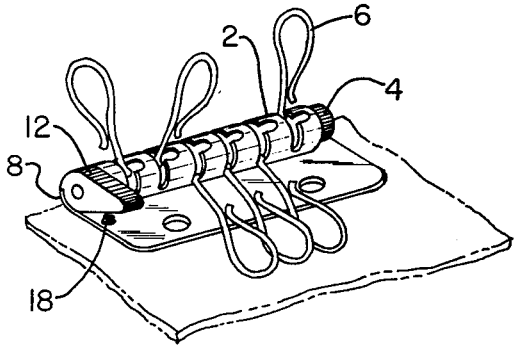
FIG. 1 is a perspective view of one form of key case head illustrative of an embodiment of the invention.

The invention is herein illustrated in connection with the key case head of the type disclosed in U.S. patent application Ser. No. 803,300 filed June 3, 1971, upon application of Oskar Hellwig, although it will be understood that other key case heads might be employed in connection with the invention.

Referring to the drawings, it will be seen that the illustrative key case head includes an outer member 2 and an inner member 4 which cooperate to releasably retain key hooks 6, as fully described in the above-mentioned application.

Figure 2:
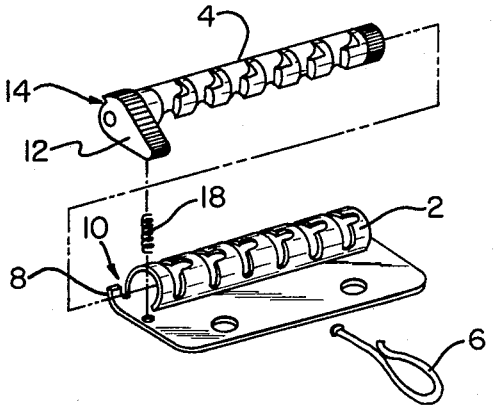
FIG. 2 is a perspective exploded view thereof.
Figure 3:
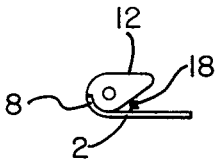
FIG. 3 is an end view thereof.
Figure 4:
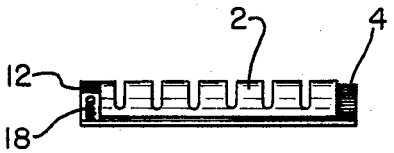
FIG. 4 is a front view thereof.
Figure 5:
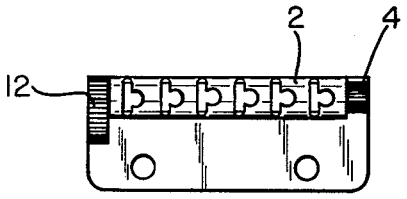
FIG. 5 is a top view thereof.
Figure 6:
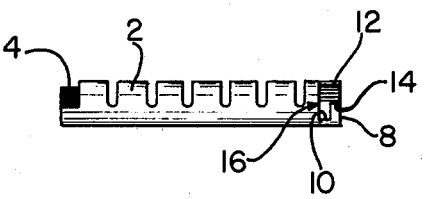
FIG. 6 is a back view thereof.

To facilitate retention of the inner member 4 within the outer member 2, the outer member 2 is provided with a lug 8 having a recess 10 adjacent thereto (FIG. 2). The inner member 4 is provided with an actuator 12 facilitating manual manipulation of the inner member. The actuator 12 is provided with a recess 14 adjacent a non-recessed portion 16 (FIG. 6). The recess 10 is complemental to and adapted to receive the non-recessed portion 16 of the actuator 12. The recess 14 is complemental to and adapted to receive the lug 8. Thus, the outer and inner members are interconnected in such a manner as to permit relative rotative movement between the two parts but prevent relative longitudinal movement.

In fabrication, the inner member 4 is slid into the outer member 2 with the inner member substantially in the position shown in FIG. 2, so that the non-recessed portion 16 of the actuator slides over the free end of the lug 8. Once the inner member is in place, a spring 18 is fitted between the actuator 12 and the outer member 2. The primary purpose for having the spring 18 is to bias the inner member in a position so as to retain the key hooks 6 within the assembly. However, the spring 18 also acts to cause the inner member to rotate so as to cause the non-recessed portion 16 of the actuator 12 to enter the recess 10 and the lug 8 to enter the recess 14.

For the inner member to subsequently be removed from the outer member, it is necessary to remove the spring 18 and all the key hooks and further necessary to depress the actuator fully. Thus, the chances of inadvertent release of the inner member are remote.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A key case head comprising an elongated inner member, an elongated generally cylindrical outer member, said inner member being adapted to move rotatably within said outer member, said inner and outer members being adapted to releasably retain key hooks therein, an actuator fixed to one end of said inner member and having recessed and non-recessed portions, said outer member having lug and recess means complemental to and adapted to receive said recessed and non-recessed portions of said inner member to interconnect said inner and outer members to permit relative rotational movement and prevent relative longitudinal movement thereof.

2. The invention according to claim 1 including spring means biasing said actuator towards a position in which said actuator recessed and non-recessed portions are in full engagement with said outer member lug and recess means.

* * * * *